US006065669A

United States Patent [19]

Correll

[11] Patent Number: 6,065,669

[45] Date of Patent: May 23, 2000

[54] SLANTING-WALL PIZZA BOX

[76] Inventor: John D. Correll, 8459 Holly Dr., Canton, Mich. 48187

[21] Appl. No.: 09/200,684

[22] Filed: Nov. 27, 1998

Related U.S. Application Data

[63] Continuation-in-part of application No. 09/002,153, Dec. 31, 1997, Pat. No. 5,881,948, which is a continuation-in-part of application No. 08/731,586, Oct. 16, 1996, Pat. No. 5,833,130.

[51] Int. Cl.[7] ..... B65D 5/22

[52] U.S. Cl. ..... 229/112; 206/518; 229/152; 229/906

[58] Field of Search ..... 229/112, 114, 229/152, 902, 906, 915, 917; 206/515, 518

[56] References Cited

U.S. PATENT DOCUMENTS

| | | | |
|---|---|---|---|
| 1,716,975 | 6/1929 | Phillips | 229/917 |
| 1,725,524 | 8/1929 | Kondolf | 229/114 |
| 4,930,681 | 6/1990 | Fultz et al. | 229/906 |
| 5,060,851 | 10/1991 | Lorenz | 229/125.29 |
| 5,226,587 | 7/1993 | Eisman et al. | 229/110 |
| 5,379,934 | 1/1995 | Lorenz | 229/125.28 |
| 5,402,930 | 4/1995 | Storms et al. | 229/125.28 |
| 5,431,333 | 7/1995 | Lorenz | 229/906 |
| 5,669,552 | 9/1997 | Watanabe | 229/114 |
| 5,713,509 | 2/1998 | Correll | 229/152 |
| 5,718,368 | 2/1998 | Rench et al. | 229/109 |
| 5,833,130 | 11/1998 | Correll | 229/152 |
| 5,881,948 | 3/1999 | Correll | 229/906 |
| 5,918,797 | 7/1999 | Correll | 229/112 |
| 5,961,035 | 10/1999 | Correll | 229/906 |

*Primary Examiner*—Gary E. Elkins

[57] ABSTRACT

A slanting-wall, one-piece, four-wall, rear-wall-reclinable pizza box comprising a tray member and a cover member hingedly attached thereto. The tray member comprises a bottom panel, a reclinable rear wall, a front wall, and opposing left and right slanting side walls extending between the front and rear walls. The cover member comprises a cover panel hingedly attached to a top edge of the rear wall and having a left-to-right width that is greater than a left-to-right width of the bottom panel.

23 Claims, 4 Drawing Sheets

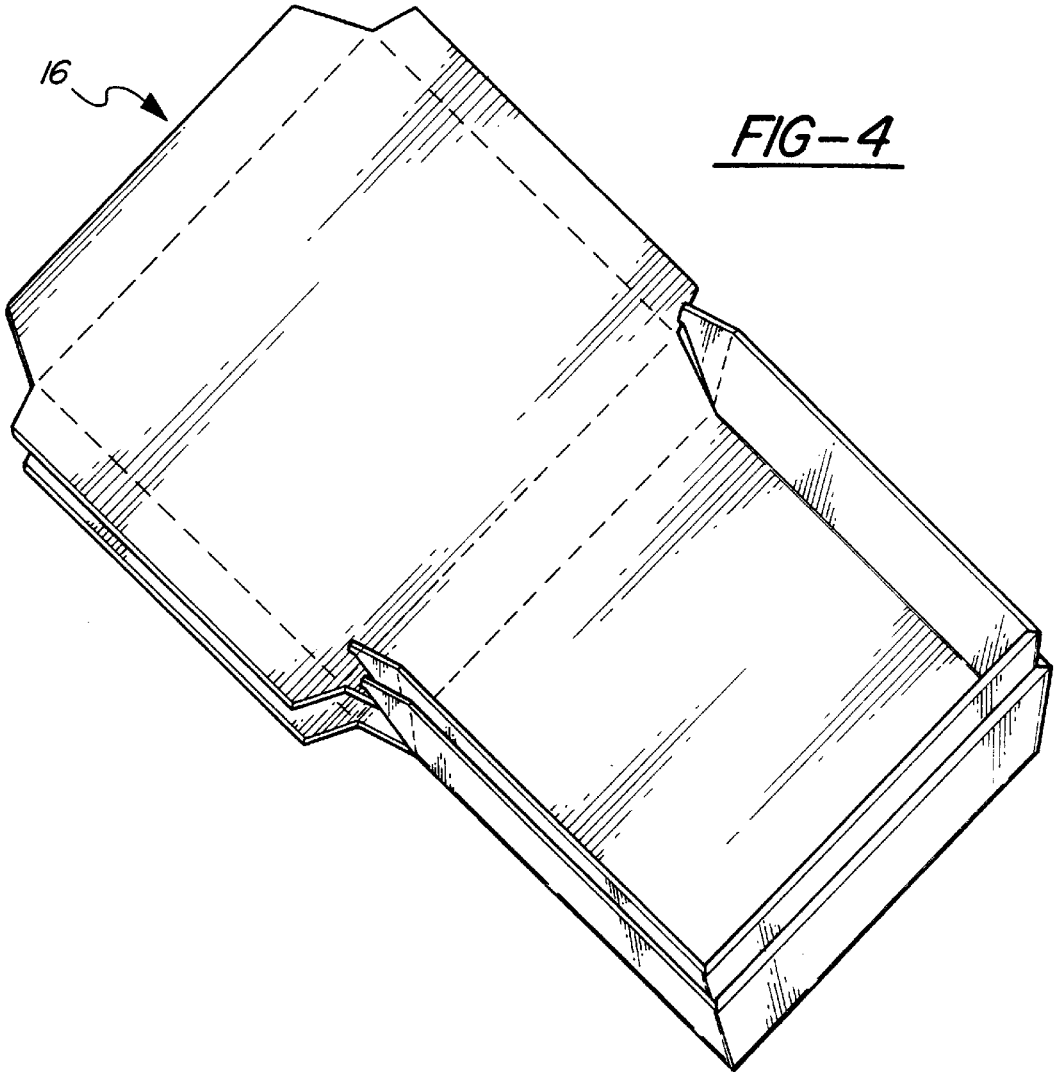
FIG-4
FIG-6
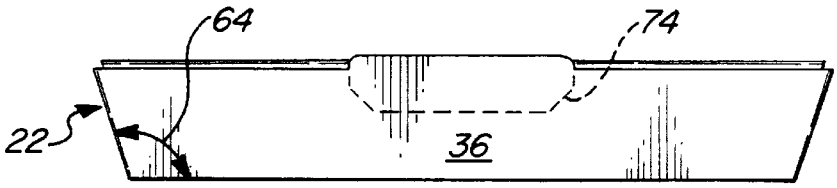
FIG-7
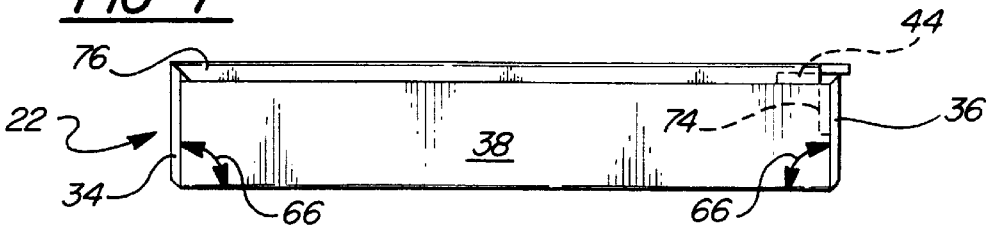

SLANTING-WALL PIZZA BOX

CROSS-REFERENCES TO RELATED APPLICATIONS

This is a continuation-in-part application of my application Ser. No. 09/002,153, entitled "Expandable Pizza Box," filed on Dec. 31, 1997, U.S. Pat. No. 5,881,948, which is a continuation in part of Ser. No. 08/731,586 Oct. 16, 1996, U.S. Pat. No. 5,833,130.

FIELD OF THE INVENTION

This invention relates to cartons made of foldable material and, in particular, to blanks and boxes for food products, such as pizza.

DESCRIPTION OF THE PRIOR ART

Prior art structure can be defined in terms of one-piece versus two-piece construction. A carton of one-piece construction, called a one-piece box, has a cover member hingedly attached to a tray member. A carton of two-piece construction, called a two-piece box, has separate cover and tray members. A two-piece box typically has two problems compared to a one-piece box. First, it's less rigid and has a less-secure cover closure, often resulting in accidental cover opening. Second, it usually requires more material to make, resulting in a more expensive carton.

Prior art structure also can be defined in terms of fastened versus non-fastened construction. A carton of fastened construction, called a fastened box, has one or more panels fastened to one or more other panels by glue or staple. A carton of non-fastened construction, called a non-fastened box, is free of glued-together and stapled-together panels. A fastened box has at least one problem: The manufacturing process for creating it is more complex and, therefore, slower and more expensive than the process for creating the blank of a non-fastened box.

In addition, prior art structure can be defined in terms of nestable versus non-nestable construction. A carton of nestable construction, called a nestable box, has a structure that allows an open box to be nested within another open box of similar structure. A carton of non-nestable structure, called a non-nestable box, has a structure that prevents a box from being nested within another box of similar structure. An example of nested boxes is shown in FIG. 4.

Further, prior art structure can be defined in terms of four-wall versus non-four-wall construction. A carton of four-wall construction, called a four-wall box, has four walls only; specifically, a front wall, rear wall, and left and right side walls extending between the front and rear walls. A carton of non-four-wall construction, called a non-four-wall box, typically has five to eight walls. As pertains to pizza, a non-four-wall box has at least three problems compared to a four-wall box. First, the area of the cover panel is usually less than that of a four-wall box, which tends to create an appearance of lesser contents and, therefore, lesser value. Second, there's usually no square corners available for packing extra items, such as a sauce cup, along with the pizza. Third, pizza company owners often find that the non-rectangular cover of a non-four-wall box is incompatible with the shape of their logo.

Still further, prior art structure can be defined in terms of reclinable rear wall versus non-reclinable rear wall construction. As used herein, a "reclinable rear wall" is defined as a rear wall that can move from an upright position to a position substantially coplanar to the bottom panel when the box cover is opened and laid back. Conversely, a "non-reclinable rear wall" is defined as a rear wall that does not assume a position coplanar to the bottom panel when the cover is opened and laid back. A carton of reclinable rear wall construction, called a rear-wall-reclinable box, is a carton having a reclinable rear wall. A carton of non-reclinable rear wall construction, called a non-rear-wall-reclinable box, is a carton having a non-reclinable rear wall. As pertains to pizza, a non-rear-wall-reclinable box has at least one problem compared to a rear-wall-reclinable box, which is, the non-reclinable rear wall prohibits the pizza from being positioned slightly rearward during the cutting phase, a practice preferred by many pizza companies.

Finally, prior art structure can be defined in terms of slanting-wall versus non-slanting-wall construction. As used herein, a "slanting wall" is defined as a wall disposed at an angle greater than 95 degrees to a bottom panel. Conversely, a "non-slanting wall" is defined as a wall disposed at an angle of 95 degrees or less to a bottom panel. A carton of slanting-wall construction, called a slanting-wall box, is a carton having one or more slanting walls. A carton of non-slanting-wall construction, called a non-slanting-wall box, is a carton having all non-slanting walls.

Currently in the pizza industry, the standard carton is a one-piece, non-fastened, nestable, four-wall, rear-wall-reclinable, non-slanting-wall corrugated box. It's used in thousands of pizzerias.

The basic structure of this standard box comprises a bottom panel, a reclinable rear wall with a cover hingedly attached thereto, a pair of opposing side walls with corner flaps attached to the front ends, and a front wall with an ancillary panel attached to the top edge which holds the corner flaps down and, thereby, holds the side walls in upright position. When properly erected, the walls of this box are vertically disposed, or non-slanting. A typical blank 24 used for making this box is shown in FIG. 8.

Used with the standard box are two basic pizza-cutting techniques: In-box cutting and out-of-box cutting. With in-box cutting, the product is placed inside a partially-erected box and then cut with a pizza wheel, which is a circular blade attached to a handle. The pizza wheel slices the product by rolling across it. To facilitate full cutting, most pizza companies place the pizza slightly rearward in the box. In out-of-box cutting, the product is placed on a board or pad and then cut either with the pizza wheel or with a rocker knife; after which the sliced pizza is slid from the board into a partially-erected box.

The partially-erected standard pizza box has vertical front and side walls and a reclined rear wall disposed coplanar to the bottom panel. It resembles box 14 shown in FIG. 3, except that in the standard box the left and right side walls are perpendicular to the bottom panel and the left-to-right width of the cover panel is the same length as the left-to-right width of the bottom panel.

With the standard box there are problems with both cutting techniques. With in-box cutting, in order to slice the pizza all the way to the edge, it's necessary to "run over" the vertically-disposed side walls with the pizza wheel, thereby creasing the walls and bending them permanently outward, which makes for a sloppy-looking box.

With out-of-box cutting, when the product is slid from the board into the box, slices of pizza often get caught on the top edge of the side walls, causing disruption of the product. To overcome this problem, some pizza companies have resorted to an oversized box that is one-half to three-fourths inch wider than the pizza's diameter. However, this results in higher packaging cost.

Another problem often occurring with the standard pizza box is that the cover side flaps may not easily slide between the pizza and the side walls of the box when the cover is being closed. This results in a crushed edge on the pizza, particularly when it's a deep-dish style pizza.

Still another problem is that, while the standard pizza box is nestable, nesting is not always easily accomplished. Specifically, nesting is possible when the box is loosely constructed and is made of thinner flute board, such as E-flute. However, when made of B-flute, nesting can result in an overly tight fit and cause bowing of the side walls.

The above-cited problems with the standard pizza box would be minimized or eliminated with outward-slanting side walls.

Recently, several variations of slanting-wall pizza boxes have appeared in the prior art. They include Lorenz U.S. Pat. No. 5,060,851 granted Oct. 29, 1991; Eisman et al. U.S. Pat. No. 5,226,587 granted Jul. 13, 1993; Lorenz U.S. Pat. No. 5,379,934 granted Jan. 10, 1995; Storms et al. U.S. Pat. No. 5,402,930 granted Apr. 4, 1995; Watanabe U.S. Pat. No. 5,669,552 granted Sep. 23, 1997; and Rench et al. U.S. Pat. No. 5,718,368 granted Feb. 17, 1998.

However, there is a major problem with all of these cartons, which is: None are a one-piece, non-fastened, rear-wall-reclinable box. Specifically, all of the boxes are non-rear-wall-reclinable boxes. Further, all of them except for Storms et al. are fastened boxes. And Storms et al. is a two-piece box. Therefore, each of the prior art slanting-wall boxes has the problems of a two-piece box, a fastened box, or a non-rear-wall-reclinable box, or a combination thereof.

In addition, with these prior art boxes all the walls are slanting walls, that is, disposed at an angle greater than 95 degrees to the bottom panel. As a result, when these boxes are loaded and stacked, the entire weight of the stack is supported by the cover of the bottom box and none of the weight is supported directly on any of the walls. As a further result, there's diminished stacking strength compared to a box with at least some of the walls being non-slanting (i.e., disposed at an angle less than 95 degrees to the bottom panel). Also, with clamshell-style boxes having both slanting walls and slanting cover side flaps, there's a tendency for the walls to buckle outwardly when a steam-soaked, loaded box is grasped along a side with one hand. The larger the box, the greater is this tendency.

To compensate for the above problems, some of the above-cited prior art boxes have been designed as non-four-wall boxes having six or eight walls instead of the usual four. This can be seen in Eisman et al., Watanabe, and Rench et al. However, non-four-wall structure results in another serious problem: It eliminates corner space in the box for packing extra items, such as a sauce cup, along with the pizza. In addition, many pizza companies find that their logo is not compatible with a non-rectangular cover and that the smaller area of the cover panel connotes lesser product quantity and value. Therefore, to serve the needs of some pizza companies, a four-wall box is desirable.

In conclusion, while some prior art boxes solve some of the above-cited problems, no single box solves all the problems. So it would be highly desirable to provide a box that can solve all those problems and, thereby, better serve the needs of pizza companies. An ideal box for solving all those problems would (a) have slanting side walls, (b) be of one-piece structure, (c) be of non-fastened structure, (d) be of four-wall structure, (e) be of rear-wall-reclinable structure, (f) be capable of being made using no more material than is required to make a standard pizza box, and (g) be capable of being equipped with at least one non-slanting wall for providing stacking strength. My invention is such a box.

OBJECT AND ADVANTAGES

Accordingly, the object of my invention is a slanting-wall, one-piece, four-wall, rear-wall-reclinable pizza box that provides a combination of advantages not provided by any other box and which, if desired, can be manufactured using no more material than is required to make a standard pizza box and can be equipped with one or two non-slanting walls for stacking strength.

Compared to a standard pizza box, the advantages of my invention are one or more of the following:

1) Easy, unobstructed loading of a pizza into the box;
2) Easier cutting of a pizza inside the box;
3) Easier closing of the box and improved product quality due to more space between the pizza and side walls for cover side flaps to slide between;
4) A better-looking box due to no bent side walls from the cutting;
5) Easier nesting of partially-erected boxes.

Compared to the prior art slanting-wall boxes, the advantages of my invention are one or more of the following:

1) No additional packaging cost due to increased material required for a two-piece non-fastened box (i.e., the Storms et al. box);
2) No additional packaging cost due to gluing or stapling process required to make a fastened box (i.e., the boxes of Lorenz '851, Lorenz '934, Eisman et al., Watanabe, and Rench et al.);
3) Optimal carton rigidity and secure cover closure;
4) Optimal stacking strength and crush resistance due to non-slanting front and/or rear wall.

Further objects and advantages of the invention will become apparent from consideration of the following detailed description, related drawings, and appended claims.

SUMMARY OF THE INVENTION

My invention is a slanting-wall, one-piece, four-wall, rear-wall-reclinable box that is capable of being manufactured using no more material than is required to make a standard pizza box and is capable of being equipped with one or two non-slanting walls for stacking strength. The box comprises a tray member and a cover member hingedly attached thereto. The tray member comprises a bottom panel, a reclinable rear wall, a front wall, and opposing left and right slanting side walls extending between the front and rear walls. The cover member comprises a cover panel hingedly attached to a top edge of the rear wall. Due to the slanting side walls, the left-to-right width of the cover panel is greater than the left-to-right width of the bottom panel.

A complete understanding of the invention can be obtained from the detailed description that follows.

BRIEF DESCRIPTION OF THE DRAWINGS

FIG. 4 is a perspective view of a stack of nested partially-erected boxes of the first embodiment.

FIG. 6 is a front elevation view of a fully-erected box of the second embodiment.

FIG. 7 is a left side view elevation view of the fully-erected box of the second embodiment.

LIST OF REFERENCE NUMERALS

Figure 1:
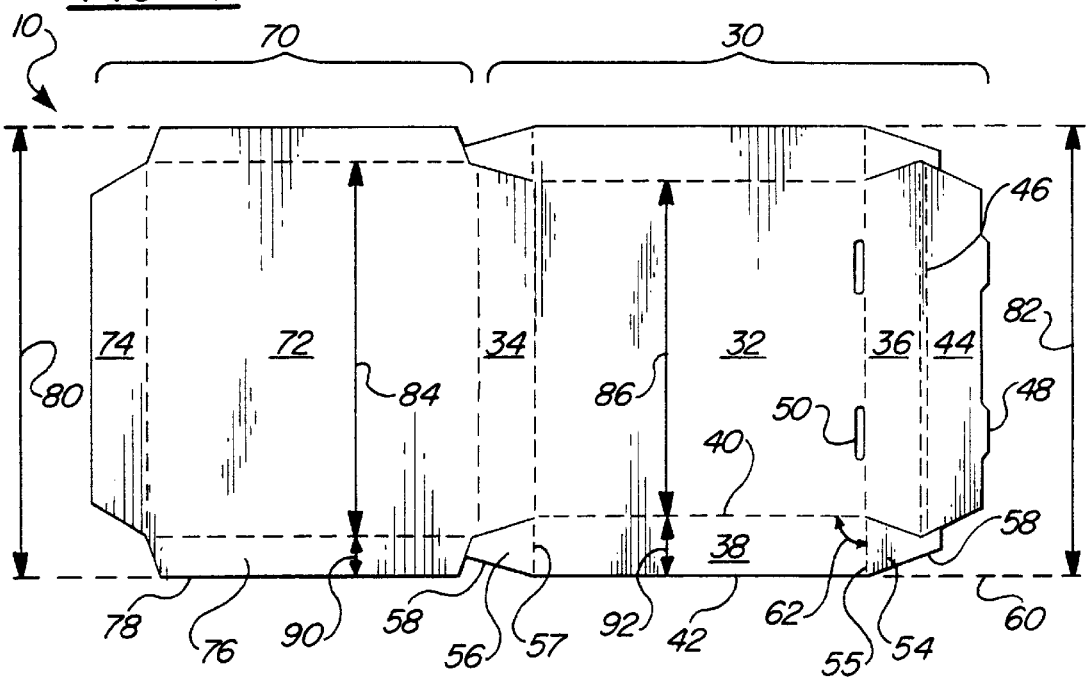
FIG. 1 is a plan view of a blank of the first preferred embodiment of the invention.

Between drawings, like reference numerals designate corresponding parts.

10 blank of the first preferred embodiment
12 fully-erected box, first embodiment
14 partially-erected box, first embodiment
16 stack of partially-erected boxes, first embodiment
20 blank of the second preferred embodiment
22 fully-erected box, second embodiment
24 blank of a standard pizza box
30 tray member
32 bottom panel
34 reclinable rear wall
36 front wall
38 side wall
40 side edge fold line
42 top edge of side wall
44 ancillary panel
46 fold line
48 interlock tab
50 interlock slot
52 cover interlock means
54 front corner flap
55 front corner flap fold line
56 rear corner flap
57 rear corner flap fold line
58 top edge of corner flap
60 imaginary line of projection
62 angle between fold lines
64 angle between side wall and bottom panel
66 angle between front/rear wall and bottom panel
70 cover member
72 cover panel
74 cover front flap
76 cover side flap
78 bottom edge of cover side flap
80 left-to-right width of cover member
82 left-to-right width of tray member
84 left-to-right width of cover panel
86 left-to-right width of bottom panel
90 maximum height of cover side flap
92 maximum height of side wall

DESCRIPTION OF THE PREFERRED EMBODIMENTS

Referring now to the drawings, there are illustrated two preferred embodiments of the invention in the format of one-piece corrugated paperboard blanks and also in the format of boxes created from the blanks. The intended use for the embodiments is as food cartons or, specifically, pizza boxes. However, it will be appreciated, as the description proceeds, that my invention may be realized in different embodiments and may be used in other applications.

Figure 2:
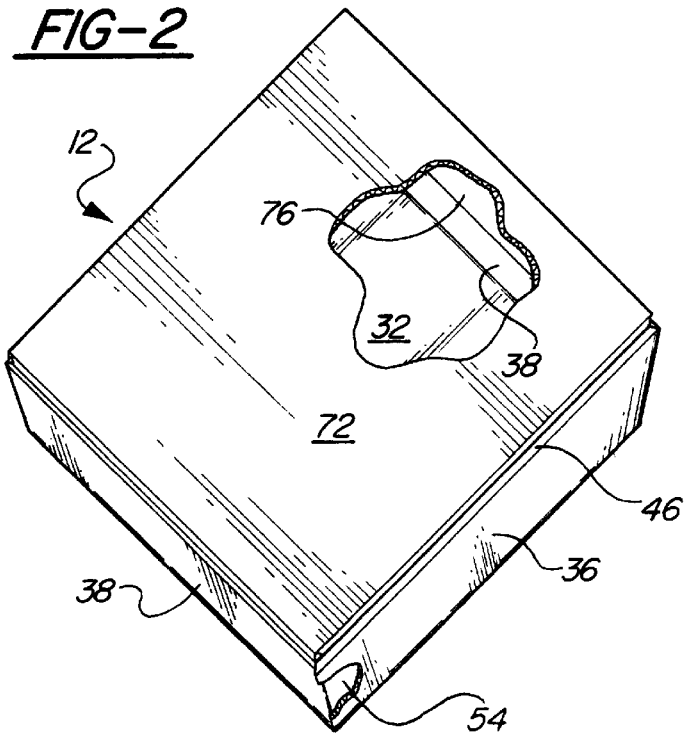
FIG. 2 is a perspective view of a fully-erected box formed from the blank of the first embodiment.
Figure 3:
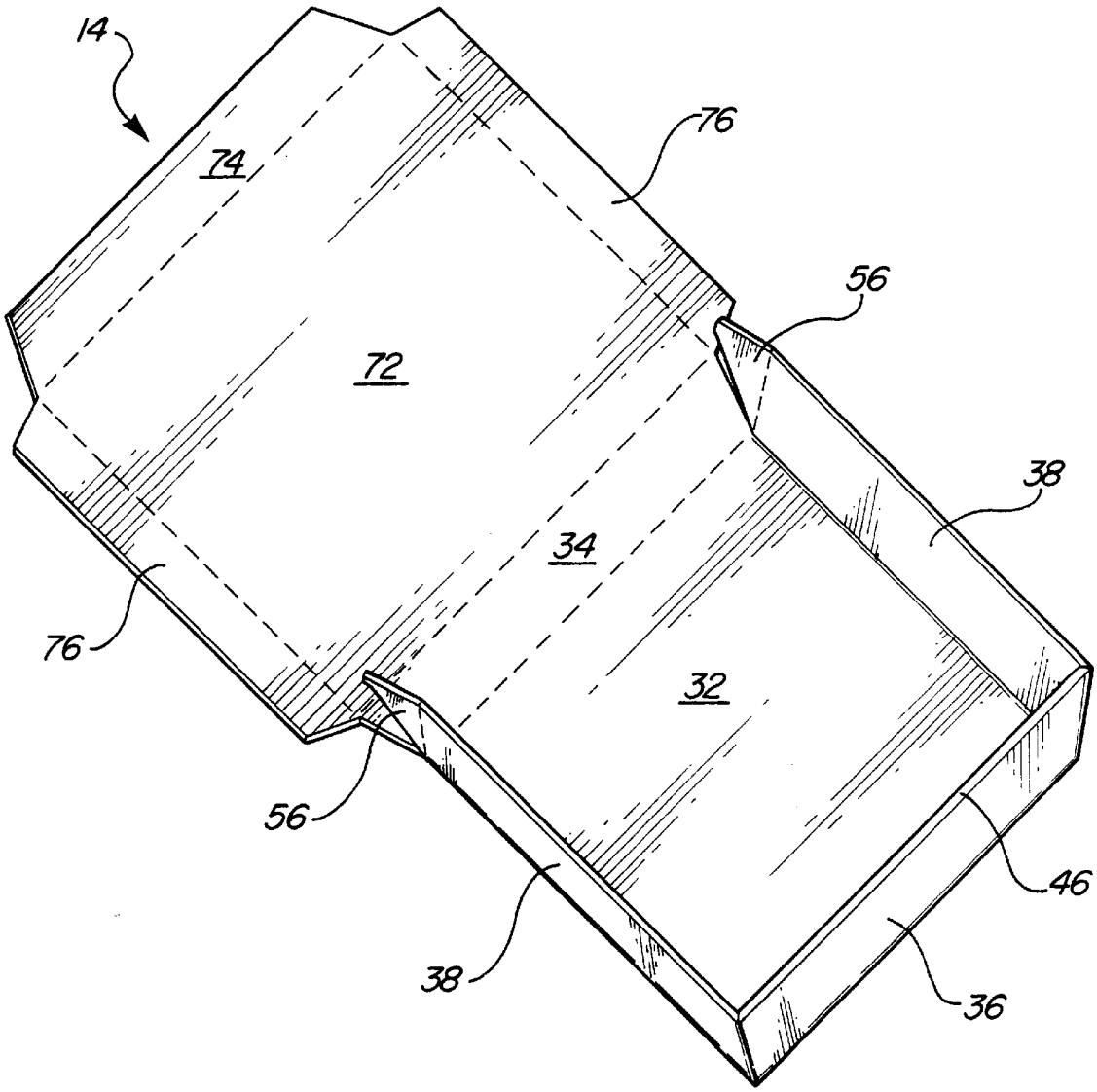
FIG. 3 is a perspective view of a partially-erected box formed from the blank of the first embodiment.
Figure 5:
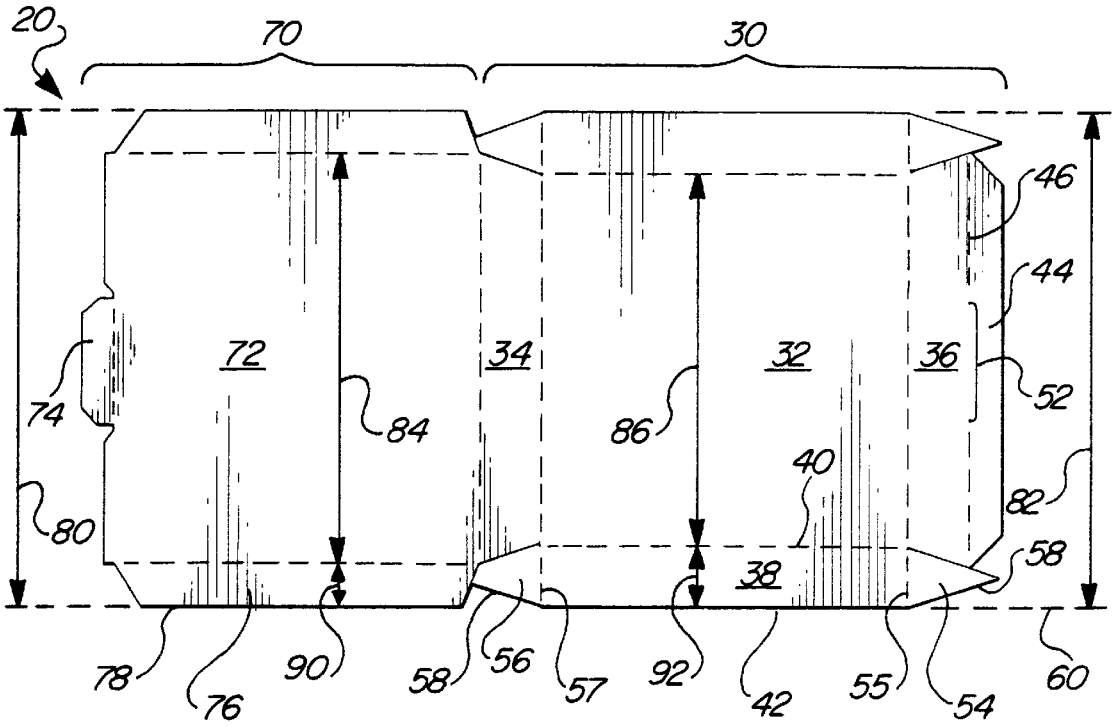
FIG. 5 is a plan view of a blank of the second preferred embodiment of the invention.

FIGS. 1, 2, and 3 show a blank 10, a fully-erected box 12, and a partially-erected box 14, respectively, of the first embodiment. FIG. 5 shows a blank 20 of the second embodiment and FIGS. 6 and 7 show front and side elevation views, respectively, of a fully-erected box 22 of the second embodiment. The following discussion pertains to both embodiments except where noted when something applies to one embodiment only. Corresponding parts between embodiments and between drawings share a same reference numeral. Referenced components are labeled in FIG. 1; selected components are labeled in other Figures.

It is noted that the invention is bilaterally symmetrical. Therefore, for simplicity of labeling, some components are indicated by numerals on one side of the drawing only. When this occurs, it is to be understood that the discussion also applies to the corresponding components on the other side, even though those components may not be labeled.

Structure of the Invention

Referring now to blanks 10 and 20 shown in FIGS. 1 and 5, respectively, there is a tray member 30 and a cover member 70.

Tray member 30 comprises a bottom panel 32, a reclinable rear wall 34 attached to a rear edge of panel 32, a front wall 36 attached to a front edge of panel 32, and a pair of opposing slanting side walls 38 hingedly attached to left and right side edges of panel 32 at a pair of side edge fold lines 40. FIG. 3, which shows partially-erected box 14, shows rear wall 34 in a position coplanar to bottom panel 32, a position which is referred to as fully-reclined position. Side wall 38 has a top edge 42.

Further comprising tray member 30, an ancillary panel 44 is hingedly linked to a top edge of front wall 36 at fold line 46. In the first embodiment, fold line 46 consists of two narrowly-spaced parallel score lines; in the second embodiment it consists of a single score line. However, fold line 46 in the first embodiment could consist of a single score line, as well. In the first embodiment, panel 44 has a pair of interlock tabs 48 that engage with a pair of interlock slots 50 to hold ancillary panel 44 parallel to front wall 36 in the box format. In the second embodiment, those features are missing, resulting in flap 44 being positioned perpendicular to front wall 36 in the box format.

The second embodiment includes a cover interlock means 52 disposed between ancillary panel 44 and front wall 36. In blank 20, means 52 takes the form of a slot-forming slit that opens into a slot to receive a cover flap when the blank is erected into a box.

The final components of tray 30 are front and rear corner flaps 54 and 56, respectively, which are hingedly attached to front and rear ends of side wall 38 at front and rear corner flap fold lines 55 and 57, respectively. Corner flaps 54 and 56 have a top edge 58.

Top edge 42 of side wall 38 has an imaginary line of projection 60 that extends forward and rearward from top edge 42. Top edge 58 of flaps 54, 56 lies below line of projection 60. In the drawings, this arrangement is depicted for edge 58 of flap 54 and is presumed to exist for flap 56 (as the rearward extension of imaginary line of projection 60 is not shown). This structure enables side wall 38 to assume a slanting disposition in the box format, as shown in FIG. 6. Further, it is noted that front and rear corner flap fold lines 55, 57 are disposed substantially perpendicular, or at an angle less than 95 degrees, to side edge fold line 40. (At the left front corner this angle is indicated by numeral 62.) This structure enables rear wall 34 and front wall 36 to assume a substantially vertical disposition in the box format, as shown in FIG. 7.

Cover member 70 comprises a full-length cover panel 72 hingedly attached to a top edge of rear wall 34. As used herein, a "full-length cover panel" is defined as a cover panel that is long enough to extend from the rear wall to the front wall when the box is fully erected. A cover front flap 74 is hingedly attached to a front edge of cover panel 72 and a pair of opposing cover side flaps 76 are hingedly attached to left and right sides of cover panel 72. Cover side flap 76 has a bottom edge 78. In the first embodiment, cover front flap 74 is a full-width panel that does not interlock with the front wall of the box. In the second embodiment, flap 74 is narrower so that it fits within cover interlock means 52. In the fully-erected box of the second embodiment, ancillary panel 44 is disposed parallel to cover panel 72, as shown in FIG. 7.

Figure 8:
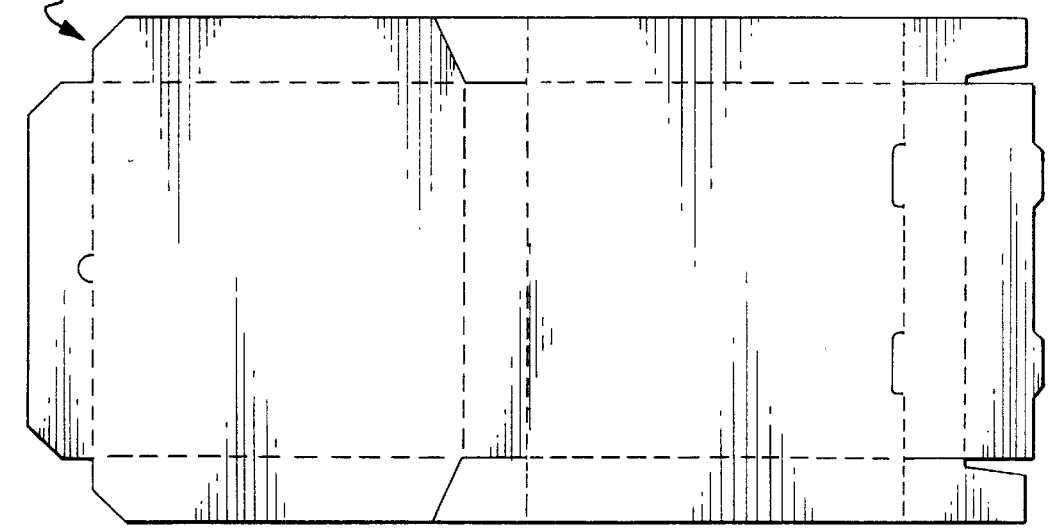
FIG-8 PRIOR ART
FIG. 8 is a plan view of a blank of a standard pizza carton (prior art).

The preferred embodiments have several key dimensions. Cover member 70 has a left-to-right width 80 that extends from the bottom edge 78 of one cover side flap 76 to the bottom edge of the opposing cover side flap. Similarly, tray member 30 has a left-to-right width 82 that extends from the top edge 42 of one side wall 38 to the top edge of the opposing side wall. It is noted that widths 80 and 82 are substantially equal. Further, cover panel 72 has a left-to-right width 84 and bottom panel 32 has a left-to-right width 86. To accommodate the outward slant of side walls 38 in the box format, width 84 is longer than width 86. Finally, cover side flap 76 has a maximum height 90 and side wall 38 has a maximum height 92. To enable width 84 to be longer than width 86, while still allowing cover and tray member widths 80, 82 to be equal, cover side flap height 90 is shorter than side wall height 92. This configuration of dimensions allows blanks 10 and 20 to be manufactured using no more material than would be used in manufacturing a blank for a standard pizza box having vertical side walls. The blank for a standard pizza box is shown as blank 24 in FIG. 8.

A modification to the first embodiment can be effected by making cover member 70 to interlock with tray member 30. To accomplish this, install a cover interlock means, or slot, between ancillary panel 44 and front wall 36 and configure the shape of cover front flap 74 to fit within it (similar to that of the second embodiment). With this arrangement, you then have the option of erecting the box with ancillary panel 44 either parallel to front wall 36 or perpendicular to it. In the latter, panel 44 would be parallel to cover panel 72 (as shown in FIG. 7). For further information on how this feature can be configured and used, refer to my U.S. Pat. No. 5,806,755, entitled "Product-protecting Pizza Carton."

Blank 10 can be set up into fully-erected box 12, shown in FIG. 2, and also into partially-erected box 14, shown in FIG. 3. Partially-erected box 14 has rear wall 34 in fully-reclined position, which is a position substantially coplanar to bottom panel 32.

To hold side wall 38 in an upright position in boxes 12, 14, and 22, corner flap 54 is disposed on an interior side of front wall 36 and flap top edge 58 is disposed in contact with fold line 46.

As shown in FIG. 6, side wall 38 of boxes 12 and 22 are disposed at an angle 64 to bottom panel 32. Angle 64 is an obtuse angle greater than 100 degrees; specifically, 108 degrees in the drawings. As shown in FIG. 7, rear wall 34 and front wall 36 of boxes 12 and 22 are each disposed at an angle 66 to bottom panel 32. Angle 66 is less than 95 degrees; specifically, a right angle in the drawing.

Methods of Use

The procedures for forming the blanks into erected boxes will now be explained; first blank 10, then blank 20.

To erect blank 10 into partially-erected box 14, the following procedure can be used. It is noted that this is the same procedure that's commonly used for erecting the standard pizza box. First, simultaneously fold both front corner flaps 54 to upright position and then fold side walls 38 inward or to upright position. Second, fold front wall 36 to upright position and then fold ancillary panel 44 downward until interlock tabs 48 engage with interlock slots 50. Front wall 36 and side walls 38 now will be upright and rear wall 34 and cover panel 72 will be coplanar with bottom panel 32.

At this point, there are three ways the partially-erected box can be used, called options one, two, and three.

Option one involves forming partially-erected box 14 into fully-erected box 12 by closing cover member 70 onto the box. To do this, first fold rear corner flaps 56 inward. Second, pull cover member 70 forward and fold cover side flaps 76 and cover front flap 74 inward so that they will slide within the box cavity, and then push cover panel 72 downward to a closed position. Typically, fully-erected boxes are stacked up for use later.

Option two involves placing a pizza into partially-erected box 14 and then forming the partially-erected box into a fully-erected box using the procedure described in option one. The pizza may be sliced either before or after being put into the box.

Option three involves nesting partially-erected box 14 inside another partially-erected box, resulting in stack 16 of partially-erected boxes, shown in FIG. 4. When it's needed, a partially-erected box is removed from the stack, loaded with pizza, and then formed into a fully-erected box using the procedure described in option one.

Blank 20 can be set up into fully-erected box 22 using the following procedure. First, position the blank horizontal, inside surface up, with the tray member end of the blank held against your abdomen and with hands placed at the rear end of side walls 38. Second, simultaneously fold side walls 38 upright. Third, while holding the side walls upright, fold rear corner flaps 56 inward with your index fingers. Fourth, while still holding the side walls upright, with your fingers pull rear wall 34 upright and then pull cover panel 72 part way forward to a position that overlies flaps 56. Fifth, fold cover side flaps 76 inward and position them interior to side walls 38 and close cover panel 72 almost all the way, leaving about a four-inch gap between the front ends of the cover panel and bottom panel. Sixth, holding the cover panel in the partially closed position, fold front corner flaps 54 inward, fold front wall 36 upright, fold ancillary panel 44 inward, and tuck cover front flap 74 into the slot created by interlock means 52. This last step can sometimes be most easily executed with the rear end of the box held against a surface. This can be accomplished by either (a) holding the box vertically with the rear end resting on a table or (b) holding the box horizontally upside down with the rear end held against your abdomen.

Definition of Key Terms

Within this specification and the ensuing claims, certain key terms are used. Many of the terms have been defined above. However, to insure clear meaning, they are further discussed here.

A "slanting-wall box" is a box having one or more slanting walls. A "slanting wall" is a wall disposed at an angle greater than 95 degrees to a bottom panel. It is noted that the standard pizza box has no slanting walls. However, due to the long length and short height of the walls of the standard pizza box, the front and side walls can tend to bow outward in the middle, especially when thinner flutes of corrugated board are used. This can result in the middle area of a wall having an outward slant. Nonetheless, a wall having such a condition is not considered to be a slanting wall. In order to be termed a slanting wall, a wall must be a slanting wall by design or intent. Typically, a wall assumes its designed or intended angle at a corner where it meets an adjacent wall in the fully-erected box.

A "one-piece box" is a box having a cover member hingedly attached to a tray member. In the preferred embodiments, the cover member is attached to the tray member at a top edge of the rear wall.

A "non-fastened box" is a box having no fastened-together panels secured by glue or staples.

A "nestable box" is a box having a structure that allows an open box to be nested within another open box of similar structure.

A "four-wall box" is a box having four walls only; specifically, a front wall, rear wall, and left and right side walls extending between the front and rear walls.

A "rear-wall-reclinable box" is a box having a reclinable rear wall. A "reclinable rear wall" is a rear wall that can move from an upright position to a position substantially coplanar to the bottom panel when the box cover is opened and laid back. It is noted that some rear walls have two sections, a lower section that remains fixed in upright position when the cover is opened and an upper section that pivots with the cover. Such a wall is considered to be a non-reclinable rear wall, as no part of the rear wall is ever disposed coplanar to the bottom panel.

A "fully-erected box" is a box having all its walls in upright position and its cover panel in closed position.

A "partially-erected box" is a box having at least some of its walls in upright position, its rear wall in fully-reclined position, and its cover panel in open position. "Fully-reclined position" occurs when the rear wall is disposed substantially coplanar with the bottom panel.

Within the context of this invention, a fold line can be created by a number of means such as, for example, by a crease or score in the board, by a series of aligned spaced short slits in the board, and by a combination of aligned spaced short and long slits. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a slanting-wall, one-piece, four-wall, rear-wall-reclinable box. The box has a number of advantages over both a standard pizza box and over the prior art slanting-wall pizza boxes.

The illustrated number, size, shape, type, and placement of components represent the preferred embodiment; however, other combinations and configurations are possible within the scope of the invention. For example, the first embodiment can be equipped with a cover interlock means, as explained above.

The foregoing discussion has pertained mainly to packaging relatively flat food products such as pizza. However, it should be realized that my invention could be used for other purposes, as well. In conclusion, it is understood that the invention is not to be limited to the disclosed embodiments but, on the contrary, is intended to cover various modifications and equivalent arrangements included within the spirit and scope of the appended claims.

I claim:

1. A fully-erected slanting-wall, one-piece, non-fastened, four-wall, rear-wall-reclinable box comprising:

(a) a tray member comprising:

(i) a bottom panel having a predetermined left-to-right width, (ii) a reclinable rear wall hingedly attached to said bottom panel and disposed thereto at a predetermined rear wall angle, (iii) a front wall attached to said bottom panel and disposed thereto at a predetermined front wall angle, (iv) left and right slanting side walls attached to said bottom panel and disposed thereto at predetermined left and right side wall angles, respectively, said left and right slanting side walls extending between said front and rear walls;

(b) a cover member comprising:

(i) a cover panel hingedly attached to a top edge of said reclinable rear wall and having a predetermined left-to-right width, the predetermined left-to-right width of said cover panel being longer than the predetermined left-to-right width of said bottom panel, (ii) a cover front flap attached to a front edge of said cover panel;

wherein:

said predetermined left and right side wall angles are greater than 100 degrees and at least one of said predetermined front wall angle and said predetermined rear wall angle is less than 95 degrees, whereby said slanting-wall, one-piece, non-fastened, four-wall, rear-wall-reclinable box provides a set of advantages not provided by either a standard one-piece carton having all non-slanting walls or a slanting-wall box of the prior art.

2. The box of claim 1 wherein:

each of said predetermined front wall angle and said predetermined rear wall angle is substantially a right angle.

3. The box of claim 1 wherein:

(a) said tray member further comprises:

(i) left and right front corner flaps attached to a front end of said left and right slanting side walls, respectively, (ii) left and right rear corner flaps attached to a rear end of said left and right slanting side walls, respectively;

(b) said cover member further comprises left and right cover side flaps attached to said cover panel and disposed interior to said left and right slanting side walls, respectively, said left and right cover side flaps being free of contact with said bottom panel.

4. The box of claim 1 wherein:

said tray member further comprises an ancillary panel linked to a top edge of said front wall.

5. The box of claim 4 wherein:

said ancillary panel is disposed substantially parallel to said front wall.

6. The box of claim 4 wherein:

said tray member further comprises a cover interlock means disposed between said ancillary panel and said front wall.

7. The box of claim 6 wherein:

said ancillary panel is disposed substantially parallel to said cover panel.

8. A blank for a slanting-wall, one-piece, non-fastened, four-wall, rear-wall-reclinable box, said blank being of foldable material cut and scored to define:

(a) a tray member comprising:

(i) a bottom panel having a predetermined left-to-right width, (ii) a reclinable rear wall hingedly attached to a rear edge of said bottom panel, (iii) a front wall attached to a front edge of said bottom panel, (iv) left and right side walls attached to said bottom panel at respective left and right side edge fold lines extending between the front and rear edges of said bottom panel, each of the side walls having a side wall top edge and an imaginary line of projection extending forward and rearward therefrom, (v) left and right front corner flaps hingedly attached to a front end of said left and right side walls at left and right front corner flap fold lines, respectively, and each having a flap top edge, (vi) left and right rear corner flaps hingedly attached to a rear end of said left and right side walls at left and right rear corner flap fold lines, respectively, and each having a flap top edge;

(b) a cover member comprising a cover panel hingedly attached to a top edge of said rear wall and having a predetermined left-to-right width;

wherein:

the predetermined left-to-right width of said cover panel is longer than the predetermined left-to-right width of said bottom panel, a substantial portion of the top edge of said left and right front corner flaps and said left and right rear corner flaps is disposed substantially below the imaginary line of projection of said left and right side walls, respectively, said left and right front corner flap fold lines are disposed at substantially a right angle to said left and right side edge fold lines, respectively, whereby after said blank is erected into said slanting-wall, one-piece, non-fastened, four-wall, rear-wall-reclinable box the left and right side walls are disposed at an obtuse angle to said bottom panel and the front wall is disposed substantially perpendicular to said bottom panel.

9. The blank of claim 8 wherein:

said left and right rear corner flap fold lines are disposed at substantially a right angle to said left and right side edge fold lines, respectively.

10. The blank of claim 9 wherein:

said tray member further comprises an ancillary panel linked to a top edge of said front wall.

11. The blank of claim 10 wherein:

said tray member further comprises a cover interlock means disposed between said ancillary panel and said front wall.

12. The blank of claim 8 wherein:

said cover member further comprises left and right cover side flaps each hingedly attached to said cover panel and having a predetermined maximum height, said left and right side walls each have a predetermined maximum height, the predetermined maximum height of each of said left and right cover side flaps is noticeably shorter than the predetermined maximum height of each of said left and right side walls.

13. The blank of claim 12 wherein:

said tray member has a predetermined left-to-right width extending from the top edge of said left side wall to the top edge of said right side wall and said cover member has a predetermined left-to-right width extending from a bottom edge of said left cover side flap to a bottom edge of said right cover side flap, said predetermined left-to-right width of said cover member is equal to said predetermined left-to-right width of said tray member.

14. A partially-erected slanting-wall, one-piece, nestable, four-wall, rear-wall-reclinable box comprising:

(a) a tray member comprising:

(i) a bottom panel having a predetermined left-to-right width, (ii) a reclinable rear wall hingedly attached to said bottom panel and disposed substantially coplanar thereto, (iii) a front wall attached to said bottom panel, (iv) left and right slanting side walls attached to said bottom panel and extending between said front and rear walls, (v) left and right front corner flaps attached to a front end of said left and right slanting side walls, respectively;

(b) a cover member comprising a cover panel hingedly attached to a top edge of said rear wall and having a predetermined left-to-right width, the predetermined left-to-right width of said cover panel being longer than the predetermined left-to-right width of said bottom panel;

wherein:

said left and right slanting side walls are each disposed at an angle greater than 95 degrees to said bottom panel, whereby, compared to a partially-erected standard one-piece carton having non-slanting side walls, said partially-erected slanting-wall, one-piece, nestable, four-wall, rear-wall-reclinable box provides opportunity for extra operational convenience such as easier nesting of a first box inside a second box, easier loading of a food product into the box, easier cutting of the food product inside the box, cutting of a pizza inside the box without running over or bending a side wall of the box, or easier insertion of cover flaps between the food product and the side walls when closing the box.

15. The box of claim 14 wherein:

said tray member further comprises left and right rear corner flaps attached to a rear end of said left and right slanting side walls, respectively, said cover member further comprises a cover front flap hingedly attached to a front edge of said cover panel.

16. The box of claim 14 wherein:

said cover member further comprises free-swinging left and right cover side flaps each hingedly attached to said cover panel and having a predetermined maximum height, said left and right slanting side walls each have a predetermined maximum height, the predetermined maximum height of each of said left and right cover side flaps is noticeably shorter than the predetermined maximum height of each of said left and right slanting side walls.

17. The box of claim 14 wherein:

said front wall is substantially perpendicular to said bottom panel.

18. The box of claim 17 wherein:

said tray member further comprises an ancillary panel linked to a top edge of said front wall and disposed substantially parallel to said front wall, said left and right front corner flaps are disposed between said front wall and said ancillary panel.

19. First and second one-piece, four-wall, rear-wall-reclinable boxes each being in an open disposition, the first box being nested inside the second box, each of said boxes comprising:

(a) a tray member comprising:

(i) a bottom panel, (ii) a reclinable rear wall hingedly attached to said bottom panel and being disposed in a reclined position, (iii) a front wall attached to said bottom panel, (iv) left and right side walls attached to said bottom panel and extending between said front and rear walls;

(b) a cover member comprising a cover panel hingedly attached to a top edge of said rear wall;

wherein said left and right side walls are each disposed at an obtuse angle to said bottom panel, whereby said first one-piece, four-wall, rear-wall-reclinable box fits relatively loosely inside of said second one-piece, four-wall, rear-wall-reclinable box and can be easily separated therefrom.

20. The first and second boxes of claim 19, wherein in each of the boxes:

said bottom panel has a predetermined left-to-right width, said cover panel has a predetermined left-to-right width, the predetermined left-to-right width of said cover panel is longer than the predetermined left-to-right width of said bottom panel.

21. The first and second boxes of claim 20, wherein in each of the boxes:

said tray member further comprises left and right rear corner flaps attached to a rear end of said left and right side walls, respectively, and an ancillary panel linked to a top edge of said front wall, said cover member further comprises free-swinging left and right cover side flaps each hingedly attached to said cover panel and having a predetermined maximum height, said left and right side walls each have a predetermined maximum height, the predetermined maximum height of each of said left and right cover side flaps is noticeably shorter than the predetermined maximum height of each of said left and right side walls.

22. The first and second boxes of claim 21, wherein in each of the boxes:

said ancillary panel is disposed substantially parallel to said front wall, said tray member further comprises left and right front corner flaps attached to a front end of said left and right side walls, respectively, a substantial portion of each of said left and right front corner flaps being disposed between said front wall and said ancillary panel.

23. The first and second boxes of claim 22, wherein in each of the boxes:

said front wall is substantially perpendicular to said bottom panel.

* * * * *